US008901409B2

(12) United States Patent
Helgesson

(10) Patent No.: US 8,901,409 B2
(45) Date of Patent: Dec. 2, 2014

(54) STRINGED MUSICAL INSTRUMENT WITH STRING ACTIVATED LIGHT EMITTING MEMBERS

(76) Inventor: Marcus Gustaf Helgesson, Danderyd (SE)

( * ) Notice: Subject to any disclaimer, the term of this patent is extended or adjusted under 35 U.S.C. 154(b) by 0 days.

(21) Appl. No.: 13/427,600

(22) Filed: Mar. 22, 2012

(65) Prior Publication Data

US 2013/0247744 A1 Sep. 26, 2013

(51) Int. Cl.
*G10H 1/18* (2006.01)

(52) U.S. Cl.
USPC ..... 84/722; 84/464 A

(58) Field of Classification Search
USPC ..... 84/464 R, 464 A, 314 R, 722
See application file for complete search history.

(56) References Cited

U.S. PATENT DOCUMENTS 2,792,738 A * 5/1957 Donahue ..... 84/267
4,306,480 A * 12/1981 Eventoff et al. ..... 84/672
4,635,518 A * 1/1987 Meno ..... 84/722
4,791,848 A * 12/1988 Blum, Jr. ..... 84/453
4,807,509 A * 2/1989 Graham ..... 84/314 R
4,901,618 A * 2/1990 Blum, Jr. ..... 84/453
5,010,800 A * 4/1991 Yoshida ..... 84/646
6,225,544 B1 * 5/2001 Sciortino ..... 84/464 A
7,427,707 B2 * 9/2008 Shaffer ..... 84/464 A
7,465,870 B1 * 12/2008 Homan ..... 84/743
8,093,482 B1 * 1/2012 Kramer et al. ..... 84/485 R
2008/0302228 A1 * 12/2008 Shaffer ..... 84/293
2009/0191932 A1 * 7/2009 Chiu et al. ..... 463/7

* cited by examiner

*Primary Examiner* — Jeffrey Donels

(57) ABSTRACT

A stringed instrument is equipped with an electrical conductor electrically connected to the frets mounted in the fretboard of said stringed instrument. Said stringed instrument is also equipped with a power source, light emitting members in electrical contact with the strings of the instrument (in one embodiment light emitting diodes) and electrical conductors electrically connecting together the components of the invention. By means of pressing down anyone of the strings capable of transmitting electric current against anyone of the frets capable of transmitting electric current connected to the electrical circuit comprised of said electrical components, said circuit closes and the light emitting member(s) associated with the string that is pressed down against the fret is lit. Preferably each string of the stringed instrument has at least one specific light emitting member connected to it.

20 Claims, 12 Drawing Sheets

STRINGED MUSICAL INSTRUMENT WITH STRING ACTIVATED LIGHT EMITTING MEMBERS

BACKGROUND OF THE INVENTION

Learning how to play a stringed instrument can be very challenging, musical compositions are often comprised of a complex series of hand, arm and finger movements. The person playing a stringed instrument needs to be in control of both hands/fingers; one hand and its fingers is used to shape the tone(s), note(s) or chord(s) by pressing down the string(s) against the fret(s) of a fretboard (also referred to as a fingerboard) and the other hand is used to make the strings vibrate via plucking, strumming or bowing. Timing and a firm and correct positioning of the hand and fingers shaping the tone(s)/note(s)/chord(s) using the string vs. fret interaction is needed to allow for pure tones to be generated.

More and more instructional videos on how to play a stringed instrument and certain musical compositions are also available on the internet; one drawback with these instructional videos is that it sometimes is very hard to distinguish between which strings are being used/pressed down when the musical composition is being played.

Also, musicians performing on stage or in a music video often seek to use lighting effects associated with their style of music and their style of play to further enhance the visual experience for an audience.

Musical instruments not having frets, like a violin or a cello, are very difficult instruments to learn and one major reason is that these instruments are lacking an indication on where to place the fingers while playing to achieve the right tone or pitch.

Various solutions to facilitate the learning process and make it easier to master stringed instruments have been suggested in the art. Examples of such solutions are US 2007/0113720 and U.S. Pat. No. 6,162,981 but these are complex solutions that can be both difficult to manufacture and expensive to employ. At the same time these and other solutions can have a negative effect on the tactile feel of the instrument.

Therefore, there is room for improvement and to provide a stringed instrument with a non-expensive and intuitive way of adding instructional functionality and visual effects without impairing the feel and function of said instrument.

BRIEF SUMMARY OF THE INVENTION

It is a general objective to provide a stringed instrument with light emitting members that are activated/lit by pressing down the strings of said instrument against the frets of said instrument.

The above and other objects are obtained by the invention which provides a stringed instrument with an electric circuit comprised of an electrical conductor (referred to as the fret conductor) in electrical contact with the frets (capable of transmitting electric current) of said instrument, one or several power sources, light emitting members (in one embodiment light emitting diodes, LEDs, without integrated resistors), one or several resistors when said resistors are needed to limit the current to the light emitting members, electrical conductors connecting together the different components of the invention and finally the strings (capable of transmitting electric current) of said stringed instrument. Once a string and fret connected to said circuit touches an electrical pathway is created and the light emitting member(s) associated with this specific string is lit.

A vast majority of frets mounted in/on stringed instruments are made of a metallic material and since many strings of stringed instruments (for instance the strings on an electric guitar or an acoustic guitar with steel strings) are also made of a metallic material both the fret and the string naturally has the natural capability of transmitting electric current. Therefore, in many cases neither the frets nor the strings need to be modified from their original form to be electrically conductive elements in the electric circuit when said circuit is closed by the string vs. fret interaction.

From a value proposition stand point, the invention offers an intuitive learning tool and a cost effective way for a person playing a stringed instrument to visualize how he or she is manipulating the strings while playing the stringed instrument. It also creates an increased expressiveness of music played on a stringed instrument, preferably when playing the stringed instrument in front of a live audience or performing in a music video.

Also, the invention offers anyone learning to play a musical composition or note patterns a fun way of training his/her upper hand finger timing via the visual feedback from the light emitting members.

BRIEF DESCRIPTION OF THE SEVERAL VIEWS OF THE DRAWINGS

The invention, together with further objects and advantages thereof, may be best understood by making reference to the following descriptions together with the accompanying drawings, in which.

DETAILED DESCRIPTION OF THE INVENTION

Figure 1:
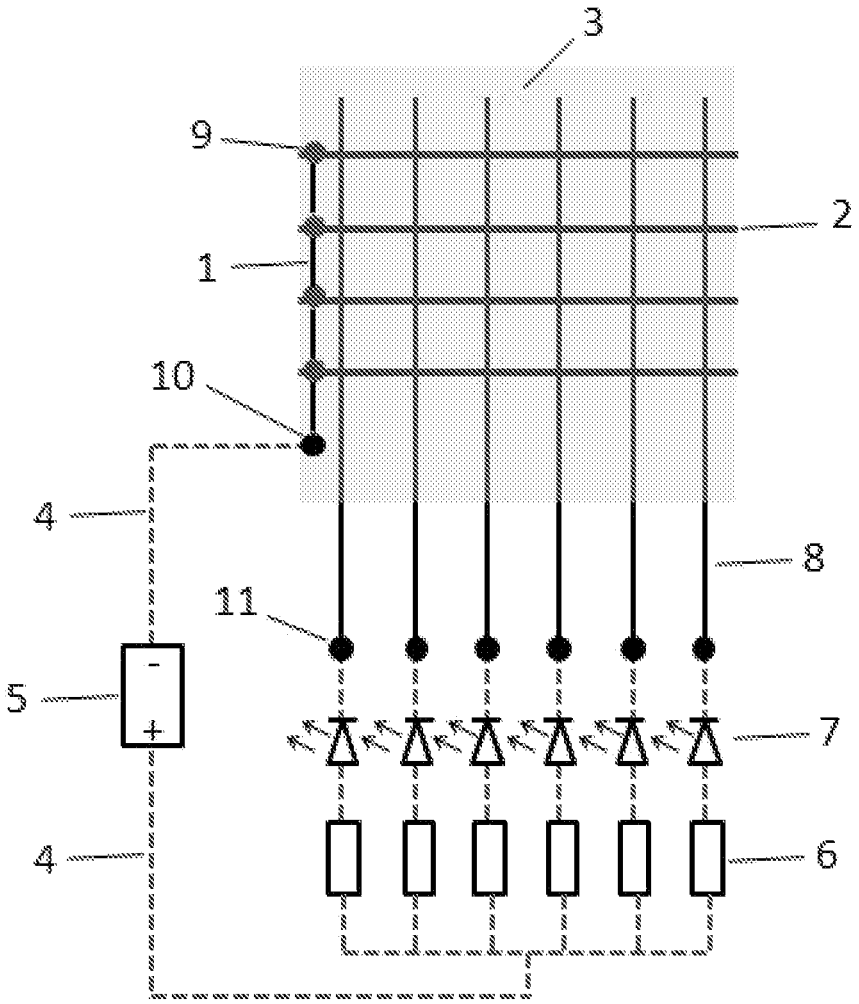
FIG. 1 Schematically illustrates how the circuit can be constructed for a six (6)-stringed instrument, here the light emitting members are represented by light emitting diodes (LEDs) without integrated resistors. In this illustration the so called fret conductor is connected to four frets. The soldering/fastening points where the frets, the electrical conductors and the strings are joined are marked by filled circles.

Referring to the drawings, FIG. 1 illustrates the invention outlined in a circuit diagram with only a portion (four frets) of a normally sized fretboard included. An insulated or non-insulated electric conductor 1 (referred to as the fret conductor), for example but not limited to a non-insulated copper wire, is connected by means of soldering, welding, gluing or mechanically connecting it at an attachment point 9 to a few or all the frets 2 mounted on/in the fretboard 3 of said instrument. The fret conductor is attached to one of several electrical conductors 4 at an attachment point 10 or directly to any of the attachment points 9. The fret conductor 1 is directly or via the electrical conductor 4, connected to a power source 5. The power source is connected to one or several electrically resistive elements 6, for example but not limited to metal film resistors, said resistors in serial or parallel connection with a number of light emitting members 7, here represented by light emitting diodes (LEDs) 7 without integrated resistors. The light emitting members are then connected to the strings 8 (capable of transmitting electric current) of the instrument via electrical conductors by means of soldering, welding, gluing or mechanically connecting those together at an attachment point 11.

Once the person playing the instrument presses down on any of the instrument's strings 8 and hereby creating an electrical pathway between the string 8 and the fret 2 (capable of transmitting electric current) the light emitting member 7 connected to this very string is lit, hereby indicating what string(s) are used by the musician when said string(s) are pressed down against the fret(s) 2 mounted in the fretboard 3 while playing the instrument. It is important to realize that if a string is played in an open style, i.e. plucking or strumming but not pressing down the string against the fretboard, the light emitting member associated with this string is not lit.

Preferably each string 8 of the stringed instrument has at least one specific light emitting member associated with it. If multiple strings of the instrument are pressed down against the fretboard 3 all light emitting members associated with these strings will light up at the same time.

Figure 2:
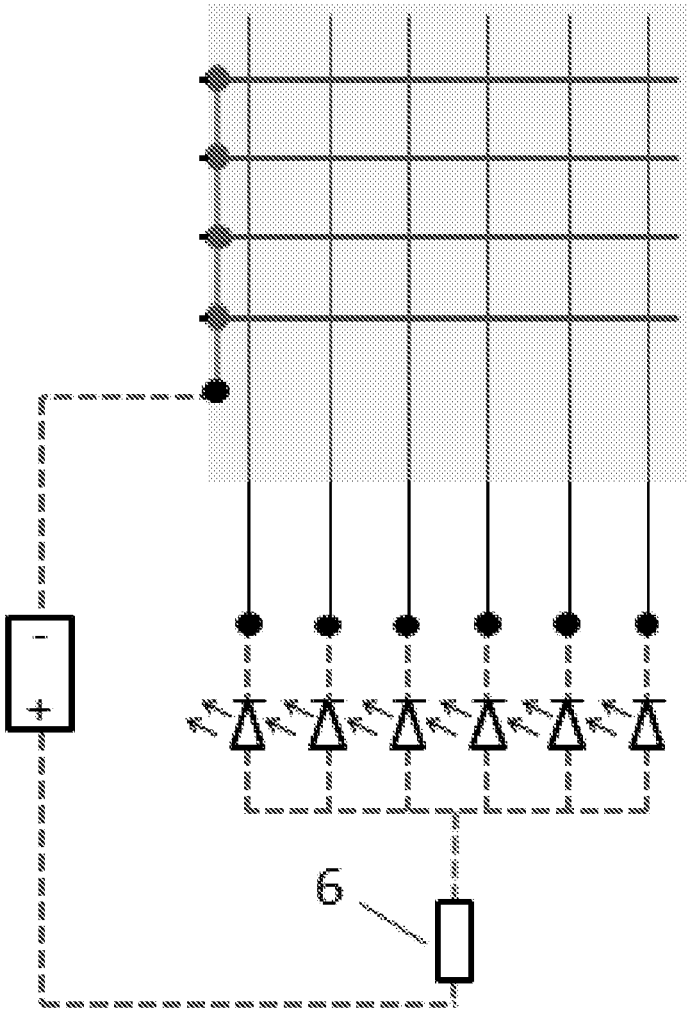
FIG. 2 Illustrates another example of how the circuit can be constructed with only one electrically resistive component connected in series with the light emitting members, here represented by light emitting diodes without integrated resistors.

The relative position of the power source 5, resistors 6 and light emitting members 7 in the circuit is of no importance for the invention to work. FIG. 2 is an example where only one resistor is connected to the circuit, even though this is one possible arrangement it will typically result in a variable light intensity in the light emitting members when more than one string is pressed down against the frets.

Figure 3:
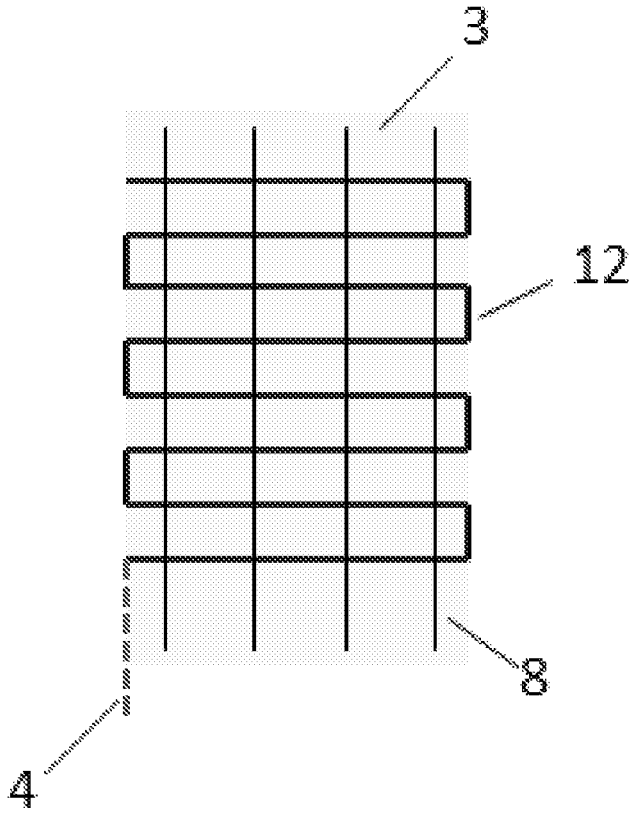
FIG. 3 Illustrates a continuous fret design where a fret connector connected to the frets at multiple points is not needed.
Figure 4:
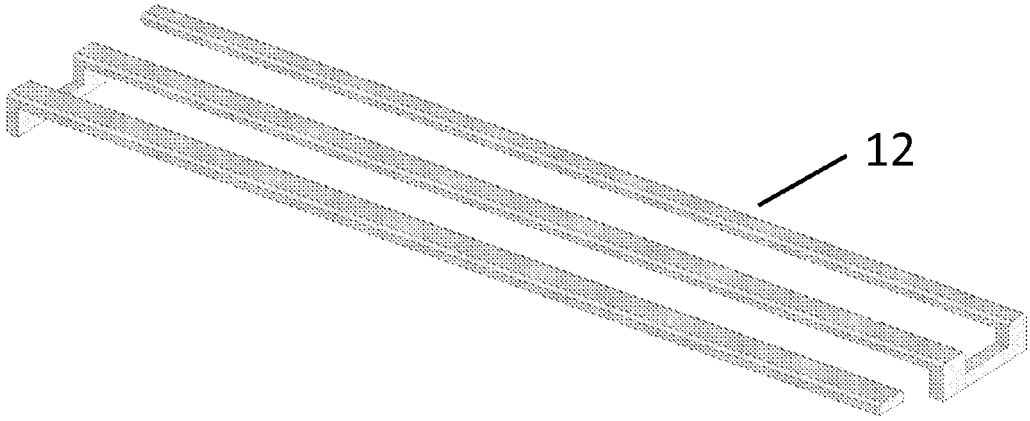
FIG. 4 Illustrates a 3D (three dimensional) representation to further explain FIG. 4, here only a portion of the repetitive fret pattern is visible.

FIG. 3 and FIG. 4 illustrate a continuous fret design 12 in which the fret itself is transmitting the electrical current to the point where it is connected to the electrical conductor 4 hereby electrically connecting the continuous fret design to the power source, hence making the so called fret conductor 1 from FIG. 1 superfluous. The 3-D fret design in FIG. 4 can also be made in a planar or flat shape.

Figure 5:
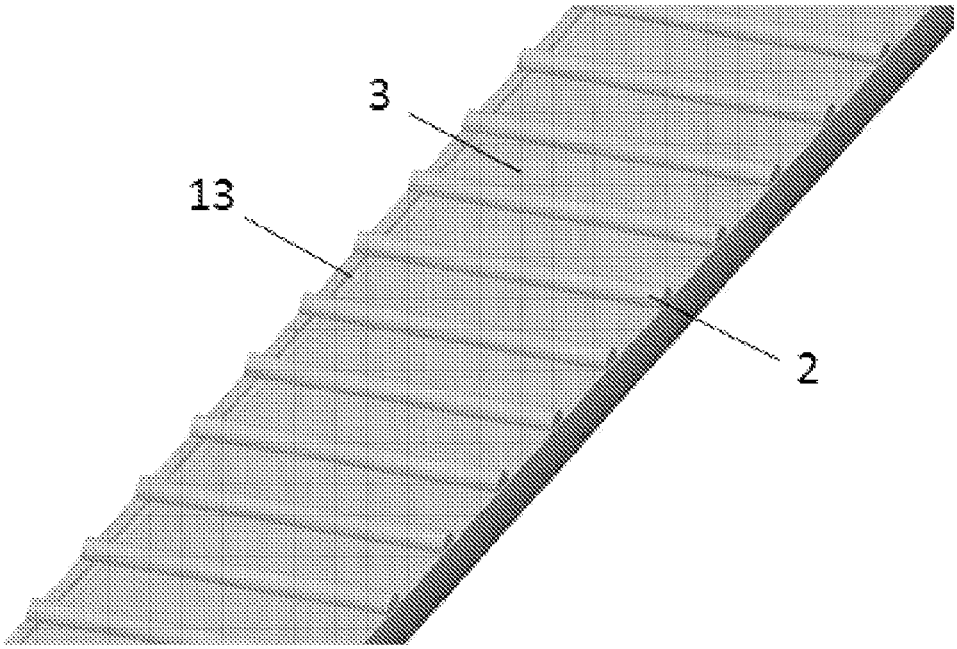
FIG. 5 Illustrates a fretboard having a groove extending all or part of the length of the fretboard/neck of the stringed instrument intended to house the fret conductor so that once the frets are installed they will be in direct contact with the fret conductor, said groove for example made by a milling machine FIG. 6 Illustrates the fret conductor clamped inside a small cavity made in each fret and hereby electrically connecting it to the frets.
Figure 6:
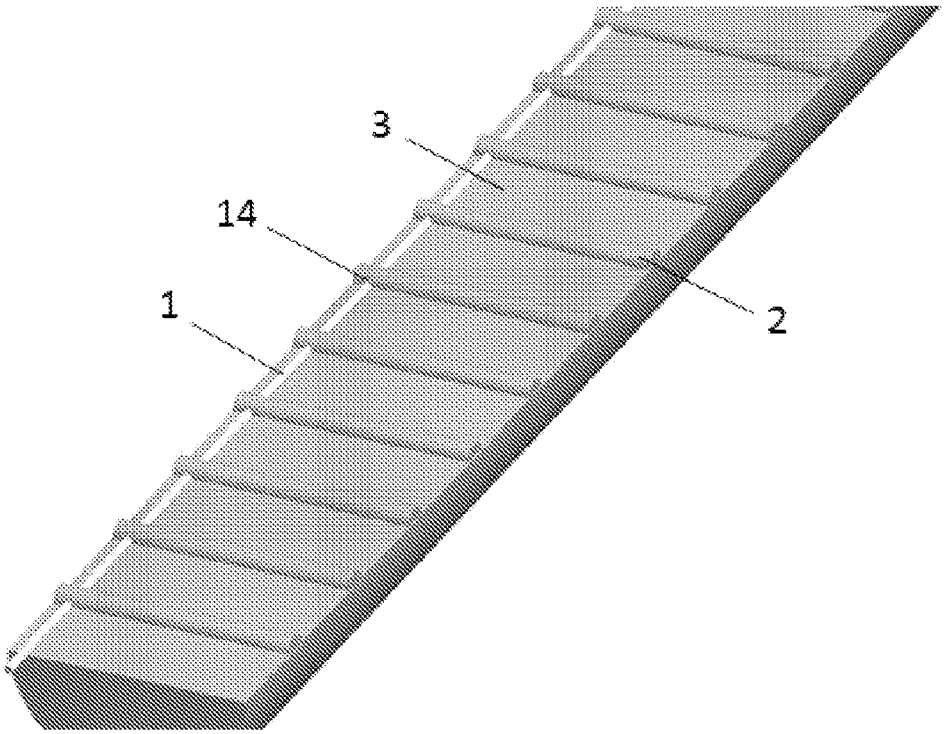

FIG. 5 and FIG. 6 display two possible embodiments for installation of the fret conductor, in FIG. 5 a cavity 13 is made in the neck/fretboard 3 of the stringed instrument in which the fret conductor 1 is placed and then clamped by the frets 2. In FIG. 6 the fret conductor 1 is clamped inside a cavity 14 made in the frets. A combination of the two methods presented in FIG. 5 and FIG. 6 is also possible to firmly secure the fret conductor against the frets and hereby creating the needed electrical pathway between said fret conductor and said frets.

Figure 7:
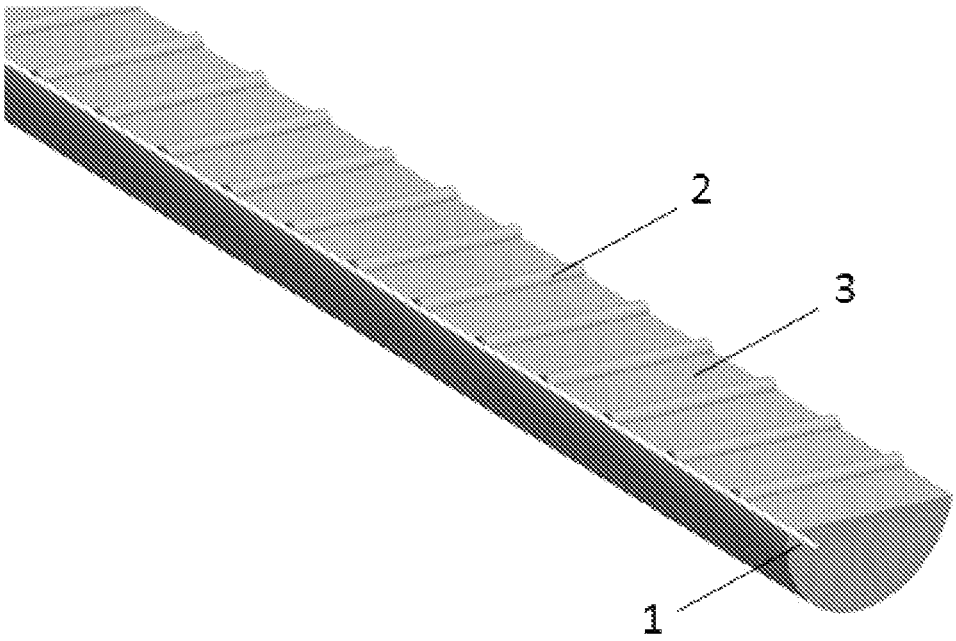
FIG. 7 Illustrates the fret conductor attached to the side of the frets, for instance by means of soldering or welding it to each individual fret.

In FIG. 7 the fret conductor 1 is soldered onto the ends of the frets.

The electrical conductors 4 linking together the different components of the invention can be fed into the stringed instrument to make them non-visible to the person playing the stringed instrument via drilled holes or milled cavities made in the body of said instrument during manufacturing of the instrument. The same hiding principle applies to the power source 5 and the electrically resistive elements; they can all be hidden on the inside of said instrument by means of positioning them in an already existing cavity or one that is specifically created for said components, for instance but not limited to a cavity in the neck of said instrument. Another way of hiding the components of the circuit, except the light emitting members, would be to place them on a surface of the stringed instruments that is totally or in large portions non-visible to the person playing the instrument or the person viewing the instrument from a spectator position. Yet another way of hiding the components would be to place them in a small container arbitrarily located on or inside said instrument. The power source/battery package and the resistors could, in one arrangement, easily be fitted on the inside of an acoustic guitar using Velcro tape.

Figure 8:
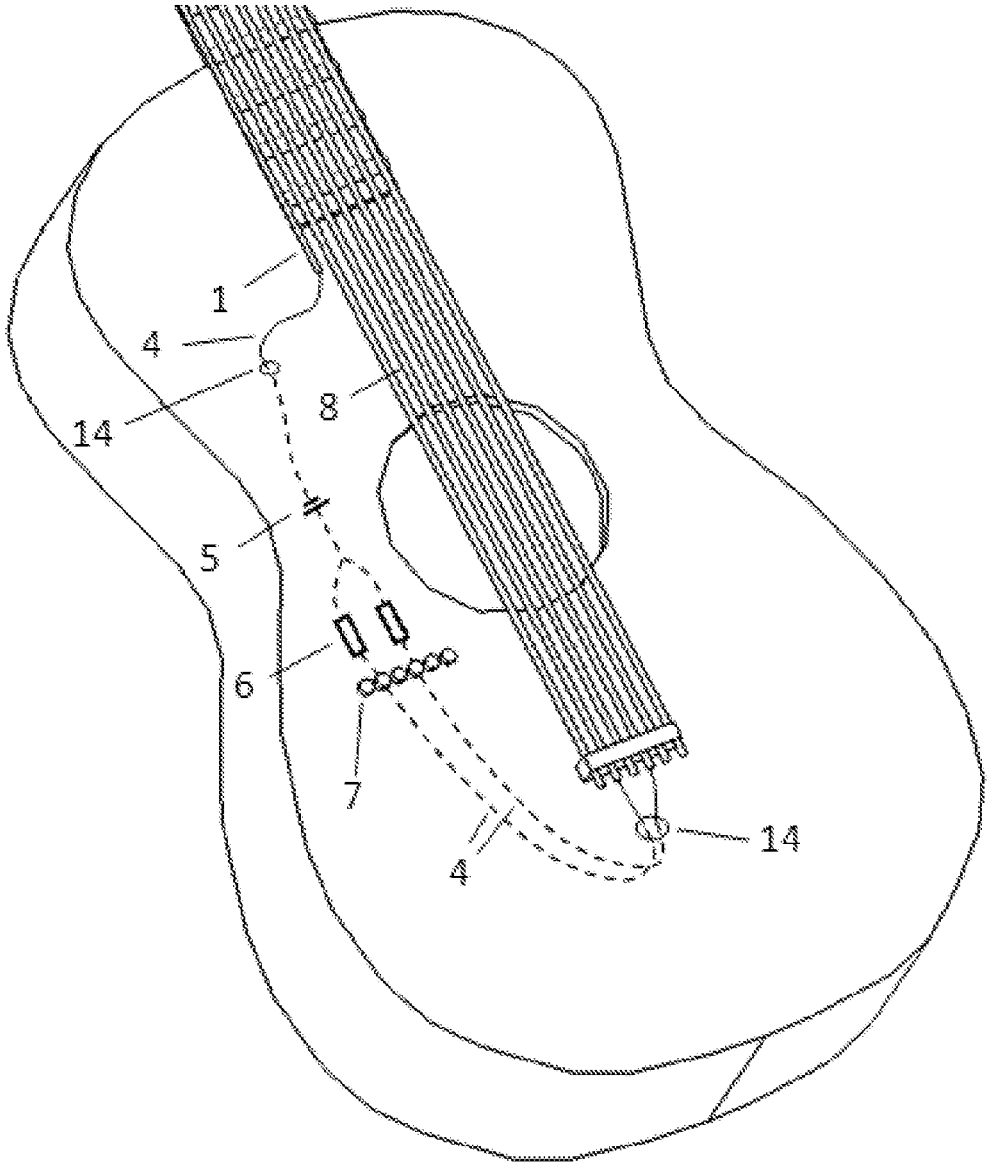
FIG. 8 Illustrates 3D representation of one possible placement of the light emitting members (here represented by LEDs without integrated resistors) installed in a 6-string acoustic guitar only having two of its six strings with their respective light emitting members connected to the battery. The strings are fed through the bridge to allow for an easy connection to the electrical circuit.

Referring to FIG. 8, holes 14 can be made in the framework/body of the stringed instrument, for instance via drilling, to feed any of the conductors into the body of the said instrument. Holes can also be made in the stringed instrument to mount the light emitting members. In FIG. 8 only two (2) of the light emitting members are connected to their respective string 8.

Figure 9:
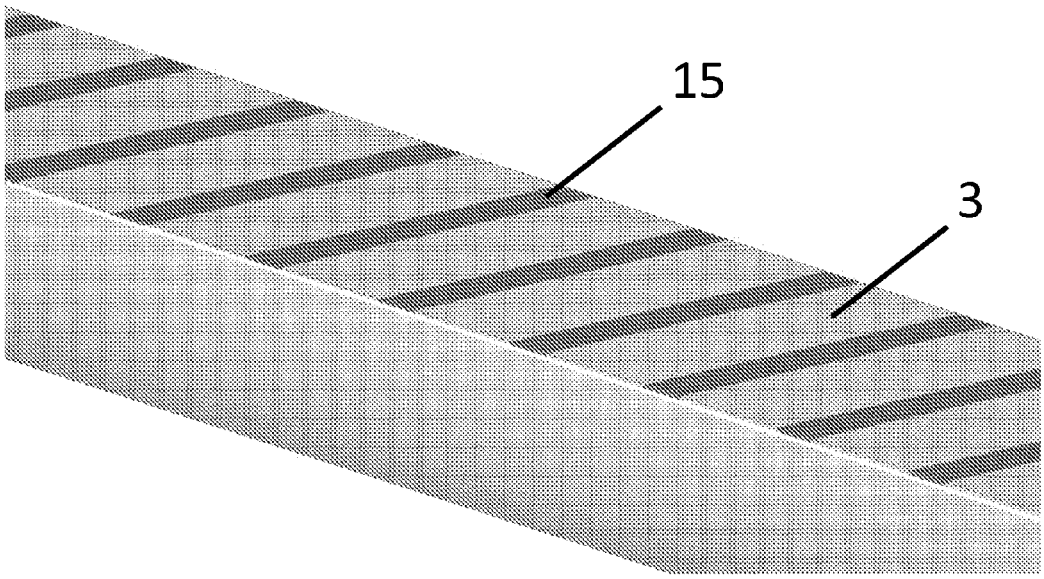
FIG. 9 Illustrates a fret design where the frets are not elevated from the upper surface of the neck for implementation of the invention on a stringed instrument which normally does not have any frets, like a violin or a cello. Here the fret conductor is preferably positioned in a cavity below said non-elevated frets.

Now referring to FIG. 9, non-elevated conductive frets 15 can be used for instruments like a violin or cello which normally does not have any fret or fretboard. In one embodiment the non-elevated frets are connected to the fret conductor and said fret conductor is preferably positioned in a cavity below the non-elevated frets not to interfere with the tactile feel of the instrument.

Figure 10:
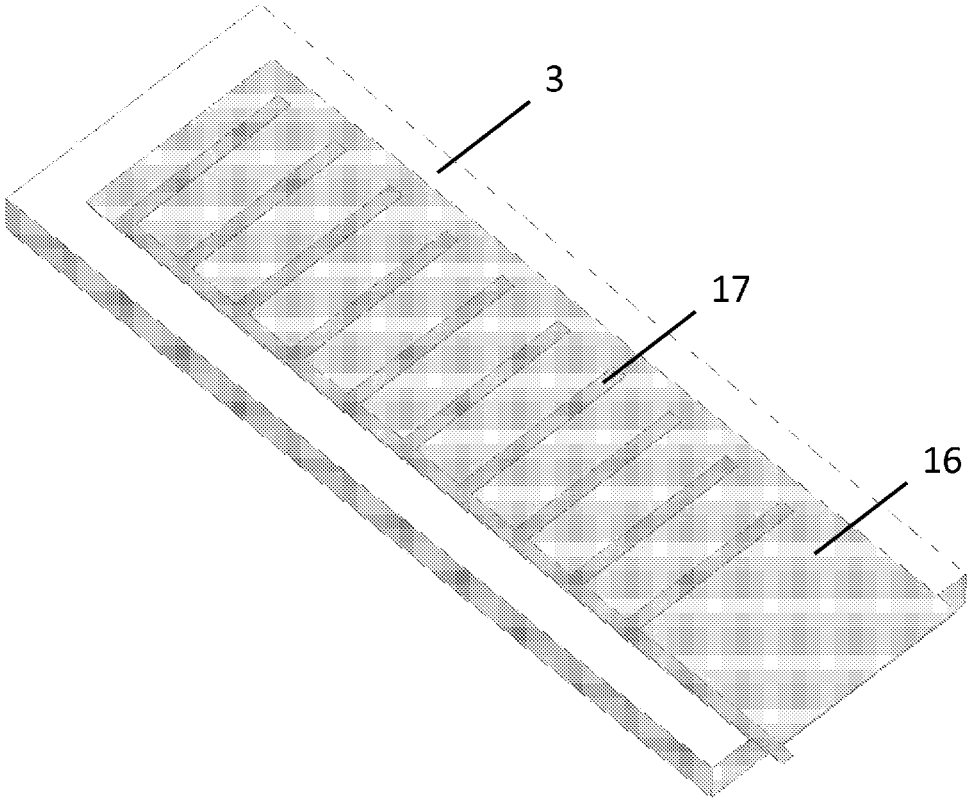
FIG. 10 Illustrates an electrical circuit printed or mounted on a flexible film or rigid material for use together with a stringed instrument that normally does not have any frets. This type of design can be made very thin and will not interfere with the tactile feel of the instrument should it be mounted directly onto the neck of said instrument.

Now referring to FIG. 10 where a plastic film or thin piece of material 16 having a printed circuit 17 mounted on top of said plastic film/thin piece of material is mounted directly onto the neck or fretboard 3 of said instrument, thus eliminating the need for installing non-elevated frets in the neck of the instrument. The printed circuit is connected to the rest of the circuit using any of the methods or combination of methods described herein. The printed circuit 17 can also be installed in a machined cavity under the frets of a stringed instrument that has frets.

Figure 11:
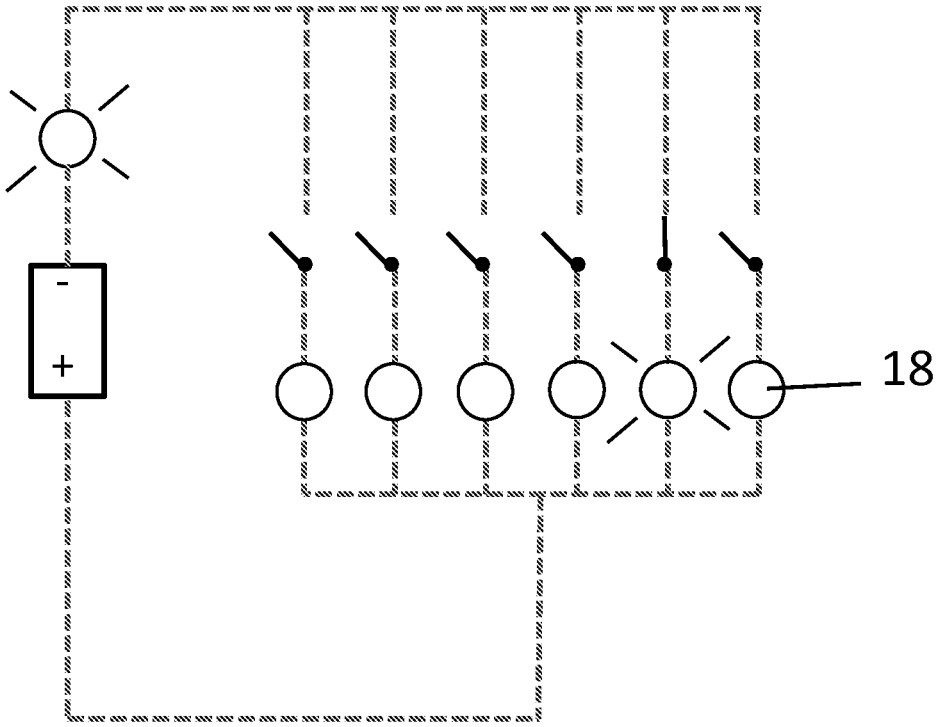
FIG. 11 Illustrates an arrangement where at least one light emitting member always is activated/lit no matter how many strings are pressed down against the frets at the same. In this illustration the light emitting members are represented by round circles and one of the strings touches a fret hereby activating two light emitting members.

FIG. 11 is an alternative representation of the circuit where a light emitting member 18 always is lit no matter what string is being pressed down against the fretboard. Also, in FIG. 11 the string vs. fret interaction is replaced by schematic switches where an open switch means that the string is not pressed down against the fretboard.

Figure 12:
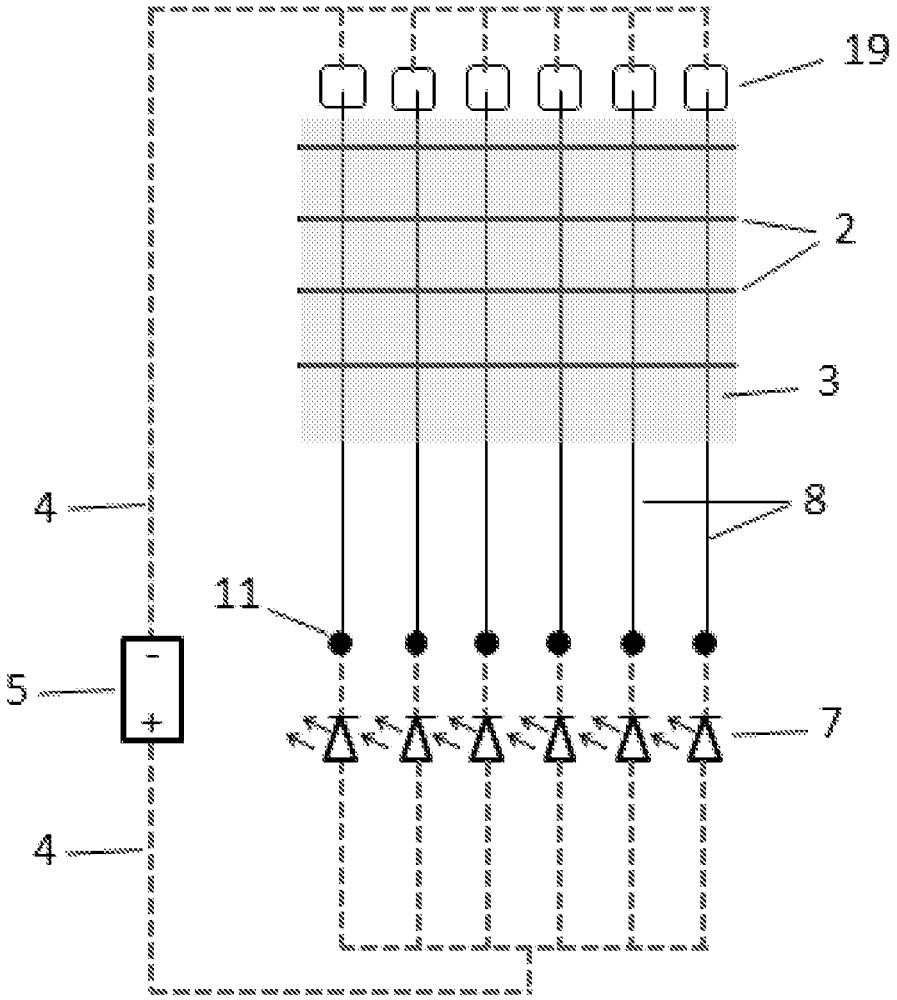
FIG. 12 Illustrates yet another embodiment of the invention where one or several contacting elements, for example but not limited to a metal rod mounted just next to the first fret, are added to the circuit. Once a string touches the added contacting element(s) the circuit will close and the corresponding light emitting member will be lit, hence making the fret conductor superfluous. In this illustration the light emitting members are represented by light emitting diodes with integrated resistors.

FIG. 12 is a representation of yet another embodiment of the invention where contacting elements 19 are added to the stringed instrument instead of using the fret conductor. Once a string 8 is pressed down it will close the electrical circuit by touching its corresponding contacting element 19 and activate the light emitting member(s) linked to said string. The contacting elements 19 can but does not need to be electrically insulated from one another.

As already pointed out the strings 8 of the stringed instrument needs to be made of an electrically conductive material, preferably a metallic material or a combination of metallic materials. An electrically conductive polymer material or a polymer having a metal coating is another example of a possible conductive string material.

The power source 5 can also be expanded to comprise two or more batteries in electrical connection, for instance but not limited to button cell batteries or AA batteries connected in series. In one arrangement two 1.5 Volt AA batteries are connected in series and for example used together with 30 mA LEDs without integrated resistors and near 100Ω metal film resistors individually connected to said LEDs. If multiple power sources are used they can also be installed at different locations in the circuit.

The light emitting members can be arbitrarily positioned on the body of the stringed instrument, underneath the strings, above the opening of an acoustic guitar mounted on a separate component and even inside the sound hole of an acoustic guitar. In one arrangement the light emitting members are placed in a semi-circular pattern just outside the sound hole of an acoustic guitar. In yet another arrangement the light emitting members are connected to the upper part of a flexible tube, hereby allowing the person playing the instrument to freely position the light emitting members which also may be installed in an array.

If the saddle or bridge are made from electrically conductive materials the strings needs to be isolated from one another by covering them with an electrical isolator, for instance a sleeve/tubing made from soft polyamide or by means of applying a polymer coating to a portion of the string where it contacts the bridge and saddle.

The light emitting members 7, 18 can all have different colors, for example one individual color for each string. The light emitting members could also be used to illuminate numerical numbers {1, 2, 3, 4, 5, 6} or letters {E, A, D, G, B, E}.

When a light emitting member 7, 18, is flickering or only partially lit this indicates that a clean tone is hard to achieve and indicates to the person playing the instrument that a better grip or hand or finger placement is needed.

Optical fibers can be used together with the light emitting members to further enhance the visual effect, directing the light away from the light emitting members 7 to arbitrary locations on the stringed instrument.

The light emitting members 7 can also be used to light up a transparent or semi-transparent piece of décor/drawing/picture installed in front of them, hereby creating another type of visual effect.

One way of connecting the strings 8 to the circuit would be to connect the strings before they enter the bridge or saddle or in between said components, for instance by means of soldering or mechanically clamping the string 8 and an electrical conductor 4 linking together the string and the light emitting member. Another way would be to intertwine the string 8 and electrical conductor 4 and clamp them together inside the bridge.

An on/off switch can be integrated into the invention to allow the person playing to decide whether or not the invention shall be in an activated or de-activated state, in the de-activated state the light emitting members will not be lit when the string 8 and the fret 2 touches.

The invention is preferably installed during the manufacturing of the stringed instrument, it can also be provided as a separate retrofitted system.

It is possible to use flashing LED circuits together with the invention.

In one embodiment an external power source can be used to provide power to the electrical circuit, hence making the power source/battery 5 superfluous.

Various changes could be made by those skilled in the art to the above mentioned arrangements and embodiments, circuit layouts, relative positions/number of components and methods of joining together said components and structures of the invention. Two such examples of joining together components or structures are different types of snap fittings or crimp bonds. Another example is to use an electrically conductive material with a high enough electrical resistivity for the strings, saddle or bridge so that no added electrically resistive elements are needed when the current flowing through the light emitting members needs to be limited. One such example is strings made from NiChrome alloy wire. It is intended that all matter contained in the above description or shown in the accompanying drawings shall be viewed upon in a non-limiting sense.

What is claimed is:

1. A stringed instrument having a plurality of strings extending the length of a fretboard where said strings are part of an electric circuit integrated in said instrument; one or several light emitting members electrically connected to said circuit are electrically activated/lit if any of the said strings come into contact with the frets of said instrument, said electric circuit comprising:

an electric conductor referred to as the fret conductor electrically connected to the frets mounted in or on the fretboard/neck of the stringed instrument;

frets capable of transmitting electric current;

strings capable of transmitting electric current;

light emitting members comprising light emitting diodes with or without integrated resistors, light emitting diode arrays, flashing light emitting diodes, laser diodes, light bulbs or any combination of said light emitting members;

one or several electrically resistive elements in serial or parallel electrical connection with the light emitting members to limit the electrical current flowing through said light emitting members;

a power source comprising one or more batteries;

insulated or non-insulated electrical conductors.

2. A stringed instrument according to claim 1 where each string of the stringed instrument is electrically connected to at least one specific light emitting member.

3. A stringed instrument according to claim 1 where every other string of the stringed instrument has at least one specific light emitting member electrically connected to it.

4. A stringed instrument according to claim 1 where the + and – poles of the power source can be electrically connected at arbitrary locations in the circuit.

5. A stringed instrument according to claim 1 where the components of the electrical circuit are secured in one or several cavities in the instrument.

6. A stringed instrument according to claim 1 where the fret conductor is installed in a cavity below the frets so that the fret conductor and the frets are in electrical contact.

7. A stringed instrument according to claim 1 where the fret conductor comprises a printed circuit mounted on a thin and electrically insulating laminate and said printed circuit and laminate are installed in a cavity below the frets so that the strings can electrically connect to said printed circuit via the frets.

8. A stringed instrument according to claim 1 where the fret conductor is directly connected to the power source without using any additional electrical conductor in between the fret conductor and the power source.

9. A stringed instrument according to claim 1 where methods of electrically connecting the components of the circuit together comprises soldering, welding, gluing and mechanically clamping them together.

10. A stringed instrument according to claim 1 where the components of the electrical circuit are positioned on or inside one or multiple components connected to the body of the stringed instrument.

11. A stringed instrument according to claim 1 where any of the components of the stringed instrument has a high enough electrical resistivity to limit the current flowing through the light emitting members.

12. A stringed instrument according to claim 1 where the light from the light emitting members is guided to specific locations using optical fibers.

13. A stringed instrument according to claim 1 where the strings are electrically insulated from the saddle/bridge using a non-conductive sleeve or non-conductive coating.

14. A stringed instrument according to claim 1 where multiple fret conductors are electrically connected to electrically insulated and individually segmented frets so that individual tones can be indicated by illuminating individual light emitting members, said light emitting members comprises a plurality of LED lights installed in a LED array.

15. A stringed instrument according to claim 1 where one or several contacting elements capable of transmitting electric current are part of the electric circuit and mounted on or in the neck of the stringed instrument so that the strings of the stringed instrument can contact them when said strings are pressed down against the fretboard, hereby eliminating the need for the fret conductor.

16. A stringed instrument according to claim 1 where the power source is replaced by an external voltage supply connected to the circuit.

17. A stringed instrument according to claim 1 wherein the instrument is a violin, viola, double bass or cello and the frets are fitted in a non-elevated fashion in the neck of the instrument.

18. A stringed instrument according to claim 17 where the neck/fretboard has a thin and electrically insulating laminate with a printed circuit mounted on it that the strings can electrically connect to when they are pressed down against the neck or fretboard.

19. A stringed instrument according to claim 17 where a micro-processor is used together with a display to detect and present chords that are being played.

20. A stringed instrument according to claim 1 where the individual frets of the fretboard are electrically connected using electrically conductive tape, electrically conductive paint or electrically conductive adhesive.

* * * * *